US007068806B2

(12) United States Patent
Walsh

(10) Patent No.: US 7,068,806 B2
(45) Date of Patent: Jun. 27, 2006

(54) CONDENSED SPEAKER SYSTEM

(76) Inventor: Casey P. Walsh, 353 Village Glen Dr., Arroyo Grande, CA (US) 93420

( * ) Notice: Subject to any disclaimer, the term of this patent is extended or adjusted under 35 U.S.C. 154(b) by 157 days.

(21) Appl. No.: 10/342,743

(22) Filed: Jan. 14, 2003

(65) Prior Publication Data

US 2004/0136560 A1 Jul. 15, 2004

(51) Int. Cl.
*H04R 1/02* (2006.01)

(52) U.S. Cl. ..... 381/351; 381/345

(58) Field of Classification Search ..... 381/150, 381/307, 334, 351, 166, 71.7, 152, 160, 162, 381/164, 165, 335, 333, 338, 342, 345, 352, 381/353, 386, 396, 413; 181/144, 145, 148, 181/198, 199, 171, 152; 267/164; 367/141, 367/174

See application file for complete search history.

(56) References Cited

U.S. PATENT DOCUMENTS

| | | | | |
|---|---|---|---|---|
| 3,042,392 | A | 7/1962 | Schmitz et al. | |
| 3,302,748 | A * | 2/1967 | Reed | 181/152 |
| 3,700,225 | A | 10/1972 | Fader et al. | |
| 3,778,562 | A * | 12/1973 | Wright | 381/335 |
| 3,891,871 | A * | 6/1975 | Henriquez et al. | 310/337 |
| 4,008,374 | A | 2/1977 | Tiefenbrun | |
| 4,101,736 | A * | 7/1978 | Czerwinski | 381/332 |
| 4,276,446 | A | 6/1981 | Taddeo | |
| 4,555,096 | A | 11/1985 | Pryor | |
| 4,637,489 | A | 1/1987 | Iwanaka et al. | |
| 4,722,517 | A * | 2/1988 | Dijkstra et al. | 267/164 |
| 4,771,994 | A | 9/1988 | Makita | |
| 5,060,274 | A * | 10/1991 | Asami et al. | 381/166 |
| 5,258,584 | A | 11/1993 | Hubbard | |
| 5,327,504 | A | 7/1994 | Hobelsberger | |
| 5,374,124 | A | 12/1994 | Edwards | |
| 5,461,676 | A | 10/1995 | Hobelsberger | |
| 5,514,841 | A | 5/1996 | Rochon | |
| 5,636,831 | A | 6/1997 | Gubitz | |
| 5,637,840 | A | 6/1997 | Kim | |
| 5,696,357 | A | 12/1997 | Starobin | |
| 5,701,358 | A | 12/1997 | Larsen et al. | |
| 5,710,395 | A | 1/1998 | Wilke | |

(Continued)

FOREIGN PATENT DOCUMENTS

WO WO 93/07729 * 4/1993

OTHER PUBLICATIONS

PCT/US04/00704. International Search Report. Dec. 8, 2004.

*Primary Examiner*—Sinh Tran
*Assistant Examiner*—Brian Ensey
(74) *Attorney, Agent, or Firm*—Thomas F. Lebens; Sinsheimer, Schiebelhut & Baggett

(57) ABSTRACT

A highly miniaturized (condensed) speaker system provides the same desirable performance characteristics as a full size acoustic suspension speaker system by incorporating a combination of one or more low pressure chambers and optionally one or more high pressure gas chambers to emulate the higher internal air volume of the full size acoustic suspension speaker system. The low pressure chamber(s) include the majority of the back (enclosed) side of the speaker diaphragm to eliminate the rigid air spring normally associated with small, enclosed volumes of air at atmospheric pressure. The high pressure gas chamber(s) provide a force to the back (enclosed) side of the diaphragm to counter the atmospheric pressure force on the face (exposed) side of the diaphragm.

7 Claims, 7 Drawing Sheets

U.S. PATENT DOCUMENTS 5,748,759 A 5/1998 Croft et al.
5,850,460 A 12/1998 Tanaka et al.
5,875,255 A 2/1999 Campbell
5,895,896 A * 4/1999 Alton, Jr. ..... 181/145
6,014,448 A * 1/2000 Alton, Jr. ..... 381/351
6,031,919 A 2/2000 Funahashi et al.
6,088,459 A 7/2000 Hobelsberger
6,130,954 A 10/2000 Carver
6,243,477 B1 6/2001 Ruiz
6,363,157 B1 3/2002 Chick
6,389,146 B1 5/2002 Croft, III
6,739,425 B1 * 5/2004 Griffin et al. ..... 181/171

* cited by examiner

CONDENSED SPEAKER SYSTEM

BACKGROUND OF INVENTION

The present invention relates generally to acoustic speakers, and more particularly to sealed speaker systems (also known in the art as acoustic suspension or air suspension speaker systems).

Sealed speaker system designs are based on placing the speaker, particularly the driver (or electroacoustic transducer) at the interface between the open listening space and a substantially closed volume of air at or near ambient barometric pressure. The main functions of the enclosed air volume are to acoustically isolate the rear of the driver from the open listening space, and to provide a controlled restoring force to the speaker's diaphragm.

In a sealed enclosure, as the diaphragm of a speaker driver moves in and out (into and out of the sealed enclosure), the speaker driver causes the volume of air inside the sealed enclosure to be compressed or expanded within the sealed enclosure, and the air outside the sealed enclosure to be compressed or expanded, setting up a sound wave that propagates through the air outside the sealed enclosure. Since no air can enter or leave the sealed enclosure (since it is sealed and because the sealed enclosure has a fixed volume, except for the excursion of the speaker diaphragm, driven by the speaker driver, into and out of the sealed enclosure), the air present in the sealed enclosure must expand to take up more space as the speaker driver moves the speaker diaphragm forward or compress to take up less space as the speaker driver moves the speaker diaphragm backward. The compression and expansion of air inside the sealed enclosure alters the pressure of the air inside the sealed enclosure compared to the ambient air pressure outside the sealed enclosure (very little temperature variation occurs). As air compresses, the air pressure increases. As air expands, the air pressure decreases. These changes in air pressure affect the diaphragm of the speaker driver since it is the only part of the sealed enclosure capable of moving. If the pressure inside the sealed enclosure is greater than the air outside (from the speaker diaphragm moving in), the high internal pressure in the sealed enclosure acts to push the speaker diaphragm out and equalize the internal air pressure with that of the air outside the sealed enclosure. If the pressure inside the sealed enclosure is less than that outside the sealed enclosure, the outside air will act to push the speaker diaphragm back toward the sealed enclosure and increase the inside air pressure, again seeking equalization. Because of the tremendous pressure differentials generated with large speaker diaphragms when such large speaker diaphragms move even a small distance, (relative to the volume of the sealed enclosure) a tremendous force can be required to move large speaker diaphragms in sealed enclosures, unless large volumes of air (relative to the distances the speaker diaphragm will be expected to move and the area of the speaker diaphragm) are contained within the sealed enclosure. Unfortunately, this means that the sealed enclosure must be large in size (or alternatively consume large amounts of power).

In an attempt to maintain low frequency response and to reduce size, open enclosures (i.e., enclosures that are not sealed) employ non-acoustic-suspension system designs having one or more acoustic resonant ports and/or chambers to constructively blend the acoustic energy radiating from the back of the speaker diaphragm with that from the front of the speaker diaphragm. This approach is known in the art as bass reflex. Some open enclosure systems also include one or more passive radiators. Unfortunately, the major disadvantage with these speaker system designs are the grossly nonlinear frequency and phase response resulting from the open enclosure design, and the loss of cone control at frequencies below the design resonance.

Striving for the audible performance advantages of a sealed design, some system designs use a plurality of drivers arranged in various push-pull or sub-chambered configurations in an attempt to overcome the large sealed enclosure required in a sealed enclosure design. These multi-driver arrangements may, on occasion, approximate the frequency response/fidelity behavior of a full-sized sealed enclosure design but at a severe power efficiency penalty.

There is thus a need in the art for a sealed enclosure design for an acoustic suspension speaker system that provides the same desirable fidelity, efficiency and output characteristics of a full-sized sealed enclosure design for an acoustic suspension speaker system without the requirement of a large sealed enclosure.

SUMMARY OF INVENTION

The present invention advantageously addresses the needs above as well as other needs such as lighter weight and increased water resistance by providing a condensed speaker system.

In one embodiment, the invention can be characterized as a speaker system comprising a speaker driver having a diaphragm with a low pressure chamber adjoining a portion of the diaphragm that is operable for forcing the diaphragm in a first direction. Also, means adjoin the diaphragm for forcing the diaphragm in a second direction opposite of the first direction.

In another embodiment, the invention can be characterized as the speaker system as described above wherein the means adjoining the diaphragm for forcing the diaphragm in a second direction opposite of the first direction comprise a high pressure chamber adjoining another portion of the diaphragm which is operable for forcing the diaphragm in a second direction opposite of the first direction.

In another embodiment, the invention can be characterized as a speaker system comprising a speaker driver having a diaphragm with a low pressure chamber adjoining a portion of the diaphragm operable for forcing the diaphragm in a first direction. A high pressure chamber also adjoins a portion of the diaphragm operable for forcing the diaphragm in a second direction opposite of the first direction. A second speaker driver has a second diaphragm and the high pressure chamber adjoins a portion of the second diaphragm. The high pressure chamber is operable for forcing the second diaphragm in the first direction. A second low pressure chamber adjoins a portion of the second diaphragm and is operable for forcing the diaphragm in the second direction.

In yet another embodiment, the invention can be characterized as an apparatus for a speaker comprising a speaker diaphragm, a low pressure chamber adjoining a portion of the diaphragm and operable for forcing the diaphragm in a first direction, and a high pressure chamber adjoining a portion of the diaphragm operable for forcing the diaphragm in a second direction opposite of the first direction.

A better understanding of the features and advantages of the present invention will be obtained by reference to the following detailed description and accompanying drawings which set forth illustrative embodiments in which the principles of the invention are utilized.

BRIEF DESCRIPTION OF DRAWINGS

The above and other aspects, features and advantages of the various embodiments of the present invention will be more apparent from the following more particular description thereof, presented in conjunction with the following drawings wherein.

Corresponding reference characters indicate corresponding components throughout the several views of the drawings.

DETAILED DESCRIPTION

The following description of the presently contemplated best mode of practicing the invention is not to be taken in a limiting sense, but is made merely for the purpose of describing the general principles of the invention. The scope of the invention should be determined with reference to the claims.

Figure 1:
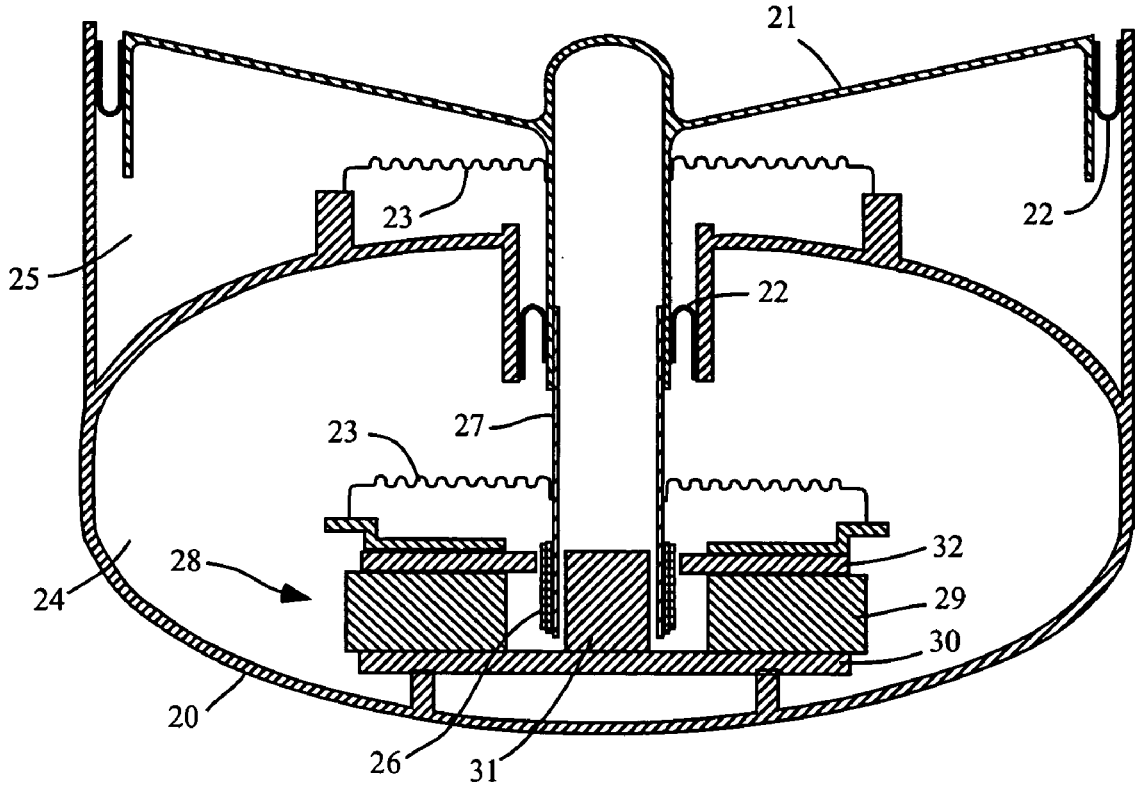
FIG. 1 is a side cross sectional view of a condensed speaker system according to an embodiment of the present invention.

Referring to FIG. 1, shown is a side cross sectional view of a condensed speaker system according to an embodiment of the present invention. Shown is a speaker housing 20, a speaker driver comprising a diaphragm 21, half-roll surrounds 22, spiders 23, a high-pressure chamber 24, a low-pressure chamber 25, a voice coil 26, a voice coil former 27, and a magnet assembly 28. The magnet assembly comprises an annular magnet 29, a bottom plate 30, a central pole piece 31, and an annular outer pole piece 32.

The housing 20 defines the high-pressure chamber 24 and the low-pressure chamber 25. It is preferably made of injected molded plastic, but may be made of other materials suitable for withstanding applied pressures (such as thin steel). The outer section of the housing is substantially U shaped with an interior section of the housing 20 forming a partial barrier between the high-pressure chamber 24 and the low-pressure chamber 25. The voice coil 26, voice coil former 27, and magnet assembly are all preferably located in the high pressure chamber 24 with the magnet assembly 28 securely mounted on the interior of the speaker housing 20. The voice coil 26 surrounds the voice coil former 27 and is in operable juxtaposition with the magnet assembly 28.

The hollow voice coil former 27 has an opening on an end that is located in the high-pressure chamber 24 and is enclosed on the other end. It also is preferably made of injected molded plastic, but may be made of other materials suitable for withstanding applied pressures (such as thin steel or aluminum and the like). The voice coil former 27 transcends the high pressure chamber 24 extending through the wall of the high pressure chamber 24 into the low pressure chamber 25 and through the center of the diaphragm 21. The diaphragm 21 is fixedly attached to the exterior of the voice coil former 27 and may also be formed integral with the exterior of the voice coil former 27. The enclosed end of the voice coil former 27 preferably has a surface area of approximately a tenth of that of the diaphragm 21 (although other proportions also work).

Half-roll surrounds 22 are located in the high pressure and low pressure chambers 24, 25. In the high pressure chamber 24 they are located between the exterior of the voice coil former 27 and the housing 20, forming a seal between the low pressure chamber 24 and high pressure chamber 25. In the low pressure chamber 25 they are located between the housing 20 and the diaphragm 21, forming a seal between the low pressure chamber and the space outside. The spiders 23 are located in the high pressure and low pressure chambers 24, 25. The spiders 23 in the high pressure chamber are secured between the magnet assembly 28 and the exterior of the voice coil former 27. The spiders 23 in the low pressure chamber 25, are secured between the housing 20 and the voice coil former 27.

By way of operation, the condensed speaker system creates sound waves basically similar to that of known speaker systems by using signals from an amplifier (not shown) that are fed into the voice coil 26 where they travel through a series of wire loops of the voice coil 26 creating an electromagnetic field. The field fluctuates with the signal becoming positive or negative along with the polarity of the signal and increases or decreases in power along with the signal power. The voice coil 26 is held in close proximity to the stationary magnet assembly 28 and is attached to the voice coil former 27, which is in turn attached to the diaphragm 21. Therefore, the voice coil 26 can move and transfer its motion to the diaphragm 21.

Magnetic fields attract or repel other magnetic fields. Two fields of the same polarity (both north or both south) repel each other. However, if the fields are of opposite polarity (one north and one south) then they attract one another. Since the voice coil 26 creates a magnetic field as current passes through it, that field is attracted to or repelled by the field of the stationary magnet assembly 28. When a signal is applied to the voice coil 26, the magnetic field it creates causes the voice coil 26 and, consequently, the entire diaphragm 21 to oscillate according to the signal. The oscillation of the diaphragm in turn accelerates air to generate sound waves.

Figure 2:
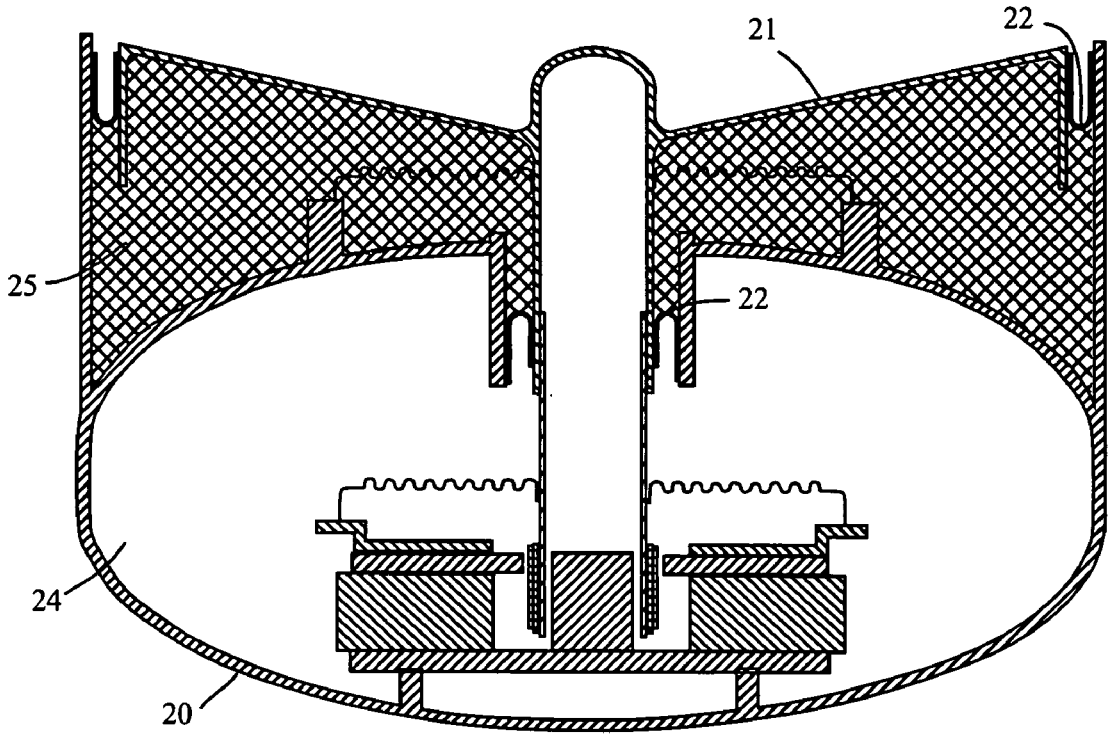
FIG. 2 is a side cross sectional view of the speaker system of FIG. 1 showing a low-pressure chamber highlighted with a hash pattern.

Referring next to FIG. 2, shown is a side cross sectional view of the speaker system of FIG. 1 showing the low-pressure chamber 25 highlighted with a hash pattern. The present invention uses at least one low pressure chamber 25 to provide the same desirable fidelity, efficiency and output characteristics of a full size acoustic suspension speaker system.

The low pressure chamber 25 of the present invention is a sealed, enclosed volume of space in which a full vacuum exists (this may also be a partial vacuum). The low pressure chamber 25, or chambers, includes a majority of a back (enclosed) side of the diaphragm 21, thus eliminating the movement-restricting air spring associated with small sealed-enclosure (acoustic suspension) designs.

Figure 3:
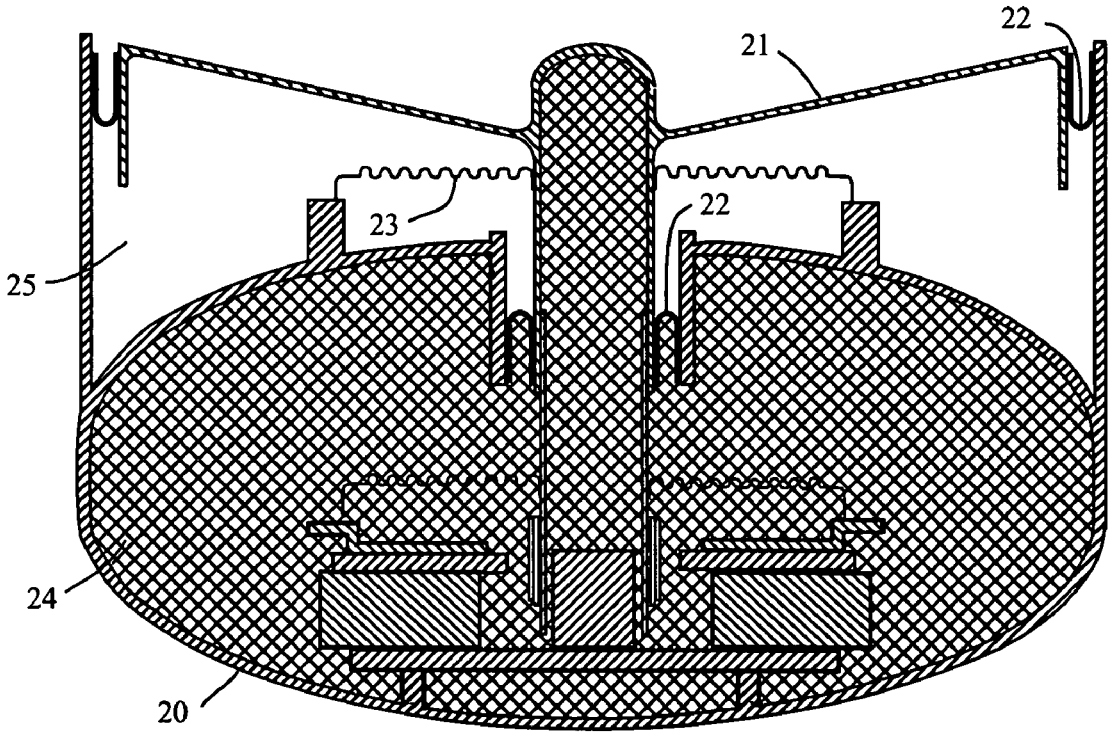
FIG. 3 is a side cross sectional view of the speaker system of FIG. 1 showing a high-pressure chamber highlighted with a hash pattern.

Referring next to FIG. 3, shown is a side cross sectional view of the speaker system of FIG. 1 showing the high-pressure chamber 24 highlighted with a hash pattern. At least one high-pressure chamber 24 is used to provide a positive air-spring restoring force to the back of the diaphragm 21. This positive air-spring force replaces the air spring constant of a much larger volume of uncompressed air. Optionally, other spring mechanisms such as, for example, a properly designed mechanical spring (not shown) can be used in place of the high-pressure gas chamber(s), provided it meets the sonic performance levels desired for a given design. However, the use of an air spring is preferable since it eliminates issues of undesirable resonance of other mechanical spring devices.

It is the use of the low-pressure chamber 25 that allows the significant reduction in size over previous designs. The volume of the low pressure chamber 25 need only be as large as is required for the diaphragm to move in order to displace sufficient air to produce sound of a desired frequency. The front (exposed) side of the diaphragm is subject to a force equal to the effective area of the diaphragm 21 multiplied by the atmospheric pressure. For a round diaphragm with a six-inch radius this comes out to $\pi$* (6 inches)$^2$* 14.7 PSI, or 1662 lbf (pounds-force). In conventional designs, an equivalent opposing force is supplied to the back side of the diaphragm 21 by an enclosed air volume. This enclosed volume of air is also what gives the diaphragm 21 a controlled restoring force whenever the diaphragm 21 is displaced from its nominal position. Since the back (enclosed) side of the diaphragm 21 is exposed to a very low pressure (or high vacuum) in the present invention (approximately 0.1–0.01 atmospheres), absent a spring, there are no significant forces present to hold the diaphragm in its nominal position. To provide this needed restoring force, a low-k spring (one with low stiffness) is used.

Figure 4:
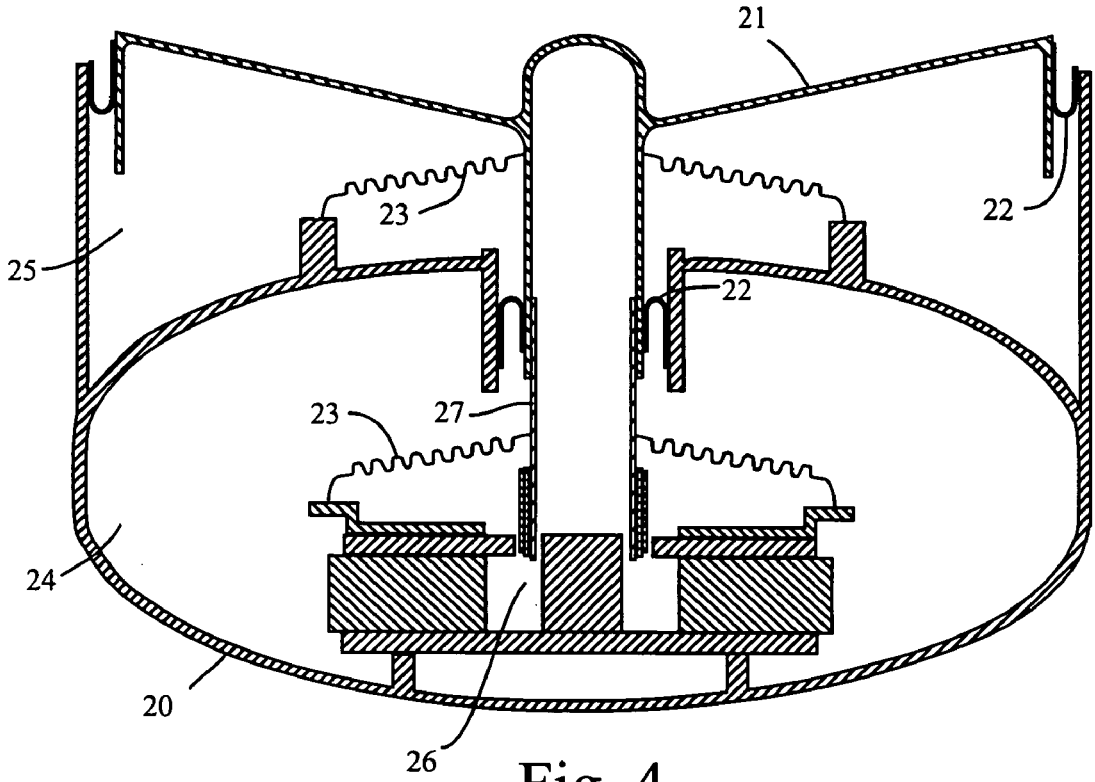
FIG. 4 is a cross sectional view of the speaker system of FIG. 1 showing a diaphragm of the speaker in an extended position.
Figure 5:
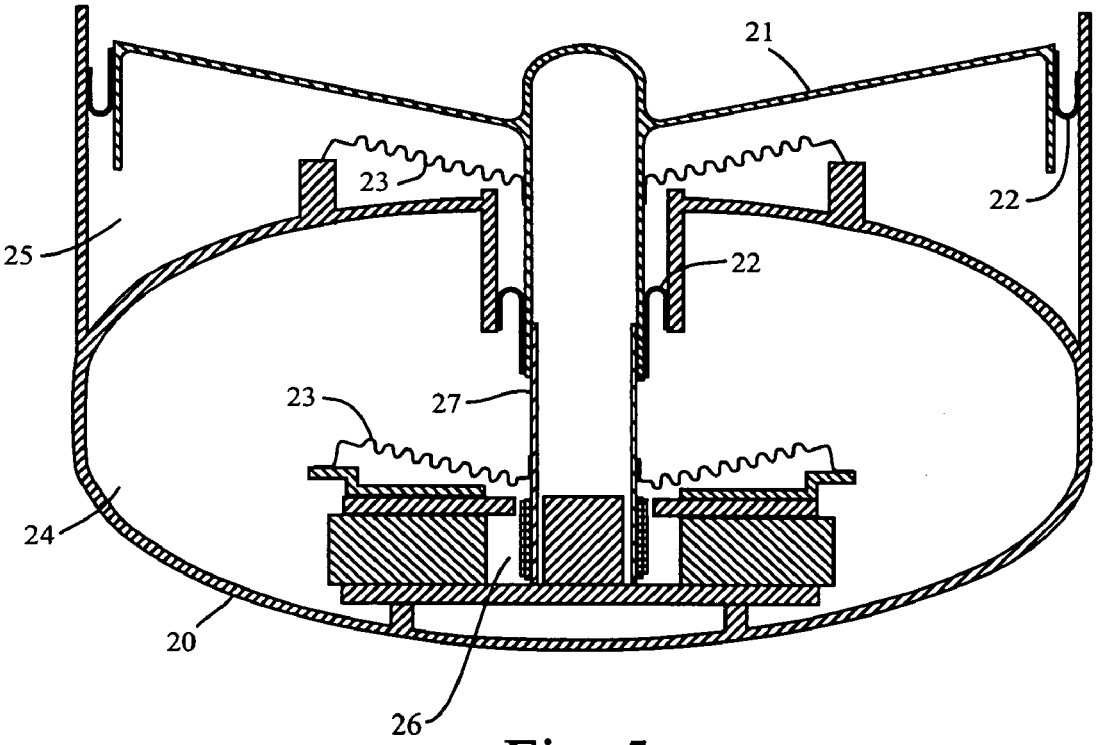
FIG. 5 is a cross sectional view of the speaker system of FIG. 1 showing a diaphragm of the speaker in a retracted position.

Referring next to FIGS. 4 and 5, shown are examples of the diaphragm 21 displaced from its nominal position. FIG. 4 is a cross sectional view of the speaker system of FIG. 1 showing the diaphragm 21 of the speaker in an extended position. FIG. 5 is a cross sectional view of the speaker system of FIG. 1 showing the diaphragm 21 of the speaker in a retracted position. The restoring effect to restore the diaphragm 21 to its nominal position (see FIG. 1) is commonly known as an "air spring". As with any spring, according to Hooke's Law (Force=k*spring displacement), there is an associated "spring constant" which defines the stiffness of the spring. This constant, is usually denoted by the letter k and has units of force per distance, such as lbf/in—(pounds per inch) or N/cm (Newton's per centimeter). Larger values of k require larger forces to achieve the same displacement. In audio applications, this translates to higher power requirements for smaller acoustic suspension speakers to get the same displacement of air and same acoustic output of a larger acoustic suspension speaker. To provide acceptable levels of efficiency, speaker system designers minimize k by maximizing the volume of enclosed air. This is because pressure and volume are inversely proportional for rigid enclosures according to the Ideal Gas Law: PV=nRT where p is the pressure and V is the volume n is the number of moles, R=0.0821 L atm mol$^{-1}$ K$^{-1}$ (that is, R is the gas constant), and T is the temperature.

This large volume is the undesirable characteristic of sealed speaker systems. The air spring characteristics of a large volume of gas are replaced with a much smaller speaker that utilizes a low-pressure chamber 25 and a low-k spring.

The low-k spring can be realized in several ways, one of which is the use of a small chamber of high-pressure gas 24. The pressure required is that which applies sufficient force to the diaphragm 21 to bring it back to its nominal position (see FIG. 1). This is inversely proportional to the ratio of the area of the enclosed end of the voice coil former 27 to the surface area of the diaphragm 21. If these areas where the same, the pressure inside the high pressure chamber would be equivalent to the atmospheric pressure that exists against the diaphragm 21. As the ratio of the area of the enclosed end of the voice coil former 27 to the surface area of the diaphragm 21 decreases, the pressure required inside the high pressure chamber 24 increases proportionally. As an example, if the area of the enclosed end of the voice coil former 27 where $1/10^{th}$ the surface area of the diaphragm 21 (a preferable ratio), then the pressure inside the high pressure chamber 24 is 10 times the atmospheric pressure that exists against the exterior surface of the diaphragm 21.

Another notable improvement of the present invention is the increased heat dissipation of the voice coil 26 and voice coil former 27. This is due to the higher pressure of the air inside the high pressure chamber 24 compared to a traditional acoustic suspension speakers. This higher pressure of air allows the heat generated to be conducted away from the voice coil quicker than if there were less air in the chamber 24.

Figure 6:
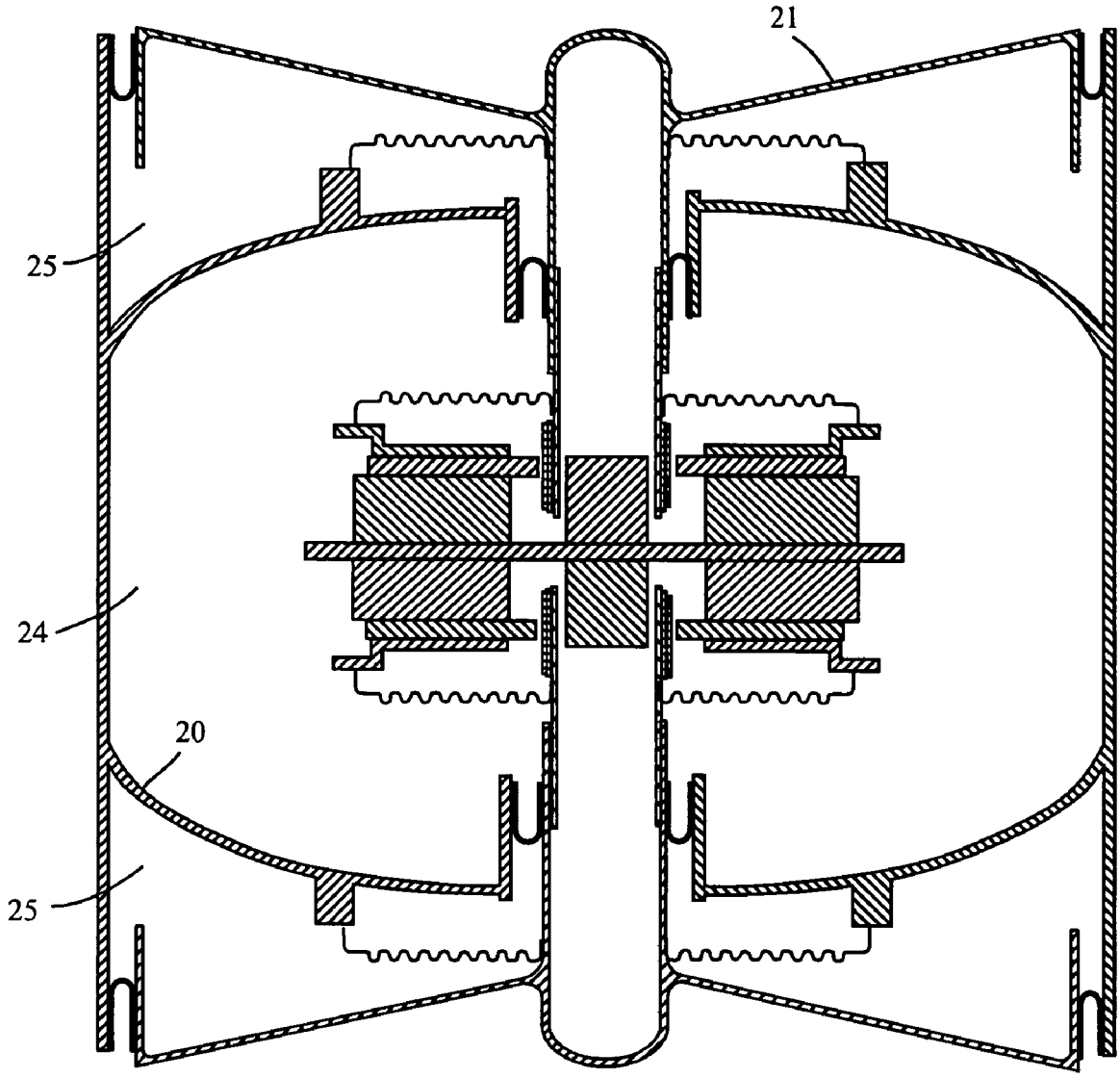
FIG. 6 is a cross sectional view of an alternative embodiment of a speaker system according to the present invention showing a symmetrical driver configuration.

Referring next to FIG. 6, shown is a cross sectional view of an alternative embodiment of a speaker system according to the present invention showing a symmetrical driver configuration. Enclosure vibrations are cancelled with this symmetrical driver configuration. This configuration is also useful for designs where minimal total weight is required.

Figure 7:
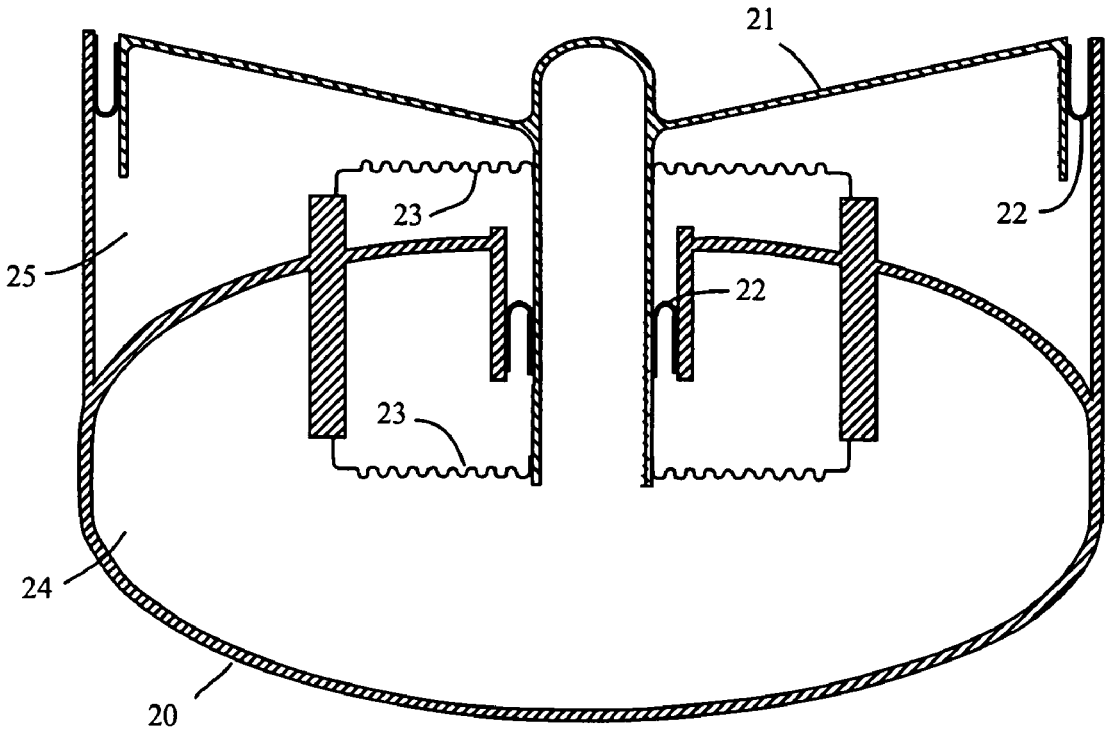
FIG. 7 is a cross sectional view of the speaker system of FIG. 1, except the voice coil and magnet assembly are omitted according to an alternative embodiment of the present invention.
Figure 8:
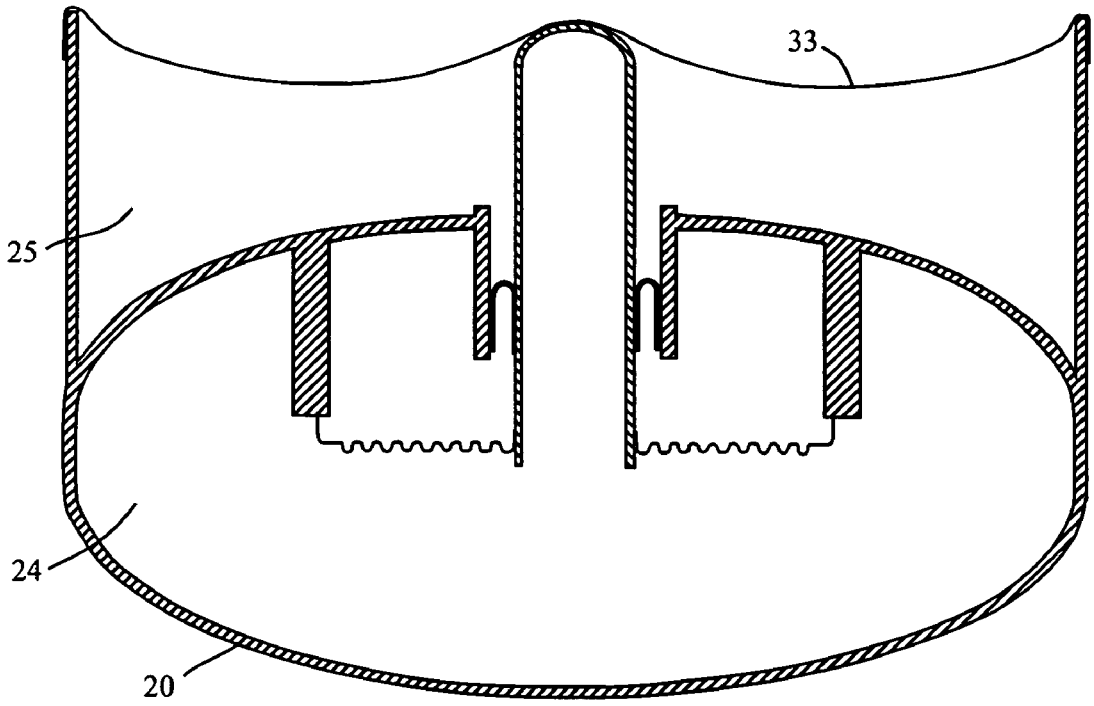
FIG. 8 is a cross sectional view of the speaker system of FIG. 7, except a rigid diaphragm structure is replaced by a taut, flexible membrane according to an alternative embodiment of the present invention.

Referring next to FIGS. 7 and 8, shown are cross sectional views of the speaker system of FIG. 1, except the voice coil and magnet assembly are omitted according to an alternative embodiment of the present invention. In FIG. 8 a rigid diaphragm structure 21 is replaced by a taut, flexible membrane 33 according to an alternative embodiment of the present invention. This passive arrangement is useful in creating a larger effective sealed volume in designs based on one or more separate loudspeaker drivers and can be used to retrofit existing loudspeaker drivers.

Figure 9:
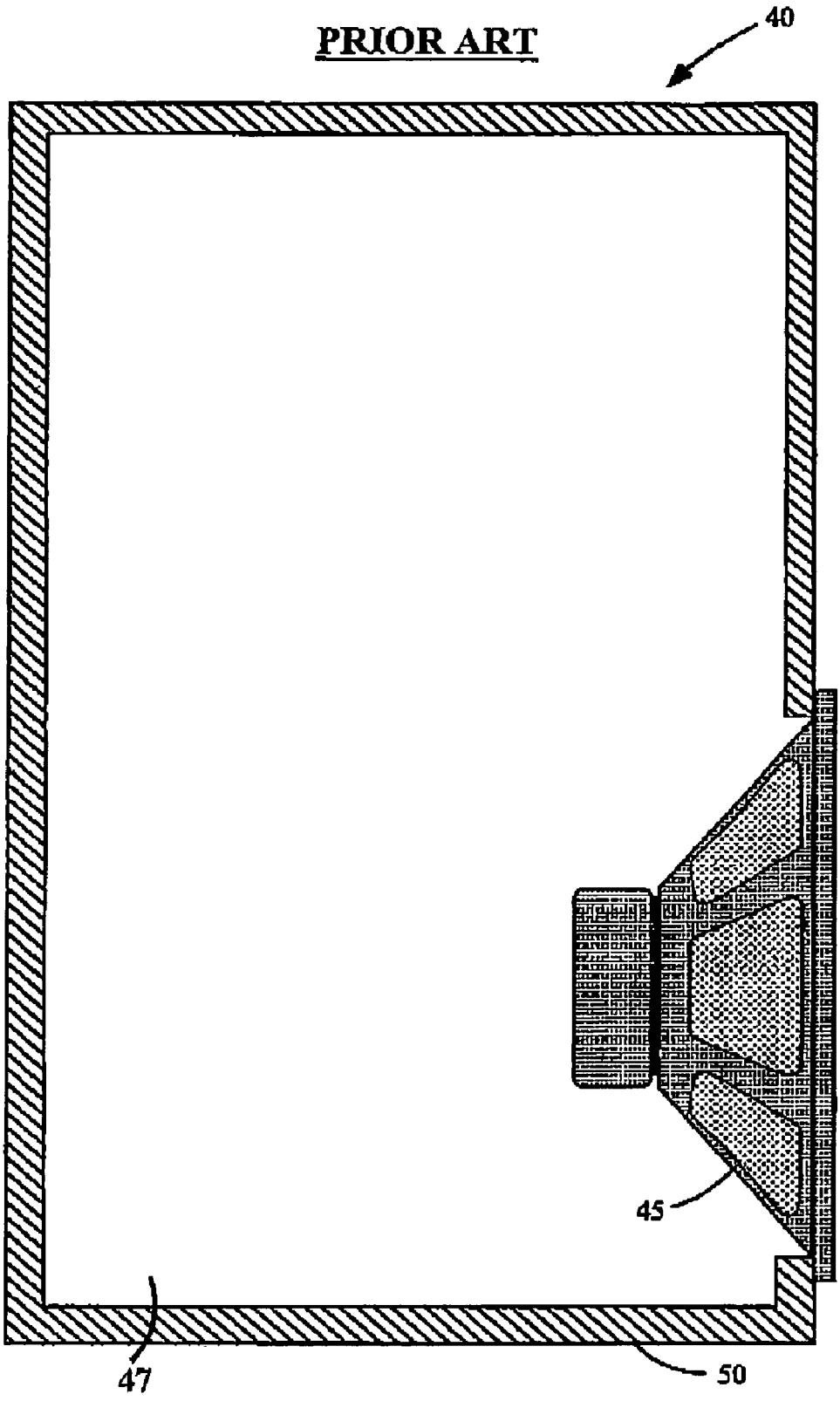
FIG. 9 is a cross sectional view of a conventional acoustic suspension speaker.

Referring next to FIG. 9, shown is a cross sectional view of a traditional acoustic suspension speaker 40. Shown is a loudspeaker driver 45 and sealed enclosure 47. In FIGS. 4 and 5, the large volume within the sealed enclosure 47 of the traditional acoustic suspension speaker 40 is replaced with a much smaller volume that utilizes a low-pressure chamber 25 and a low-k spring. The passive arrangements of FIGS. 7 and 8 may also be enclosed in the speaker 40 to create an even larger effective sealed volume.

Figure 10:
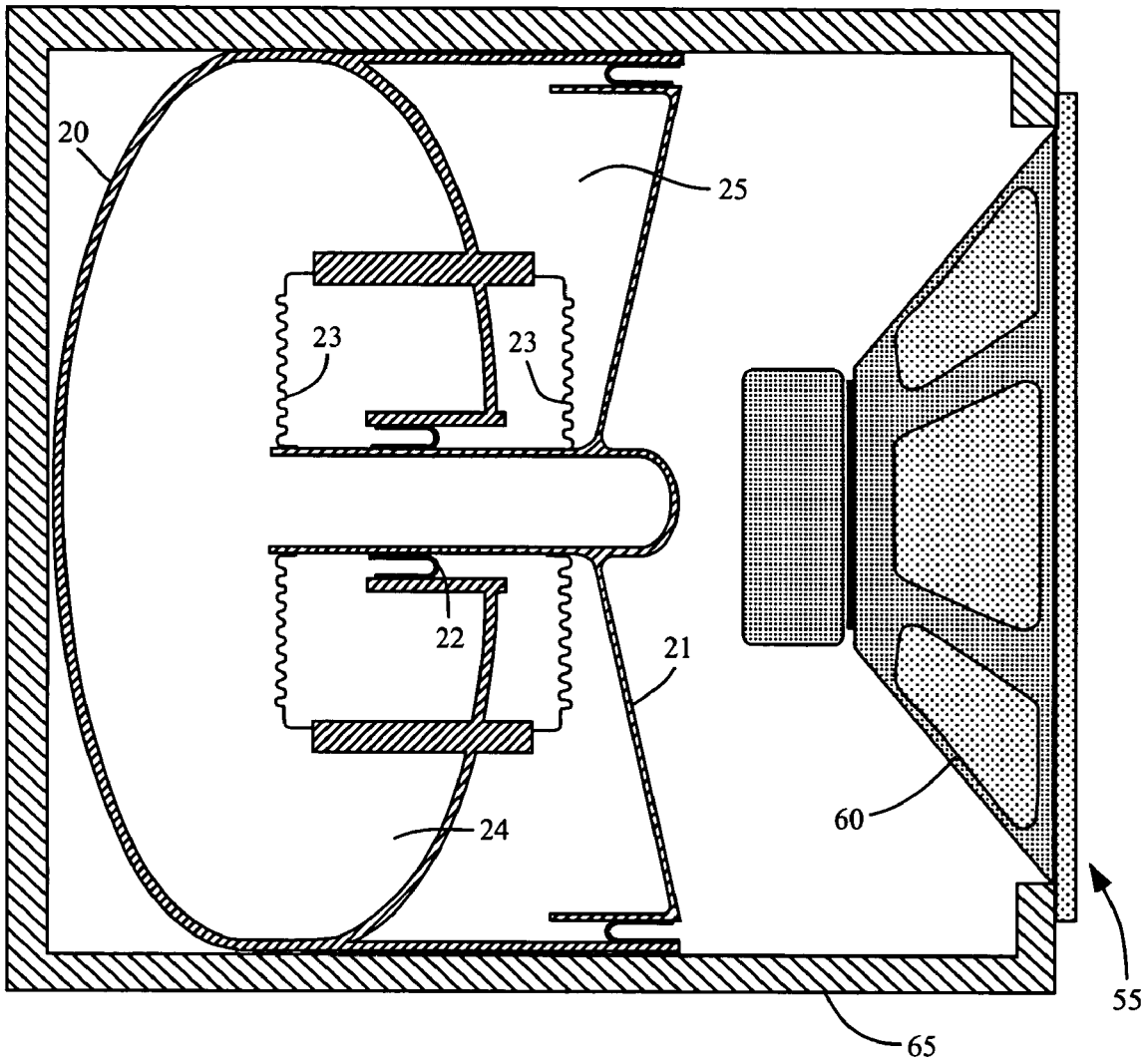
FIG. 10 is the speaker system of FIG. 7 enclosed in an acoustic suspension speaker according to an alternative embodiment of the present invention.

Referring next to FIG. 10, shown is the passive arrangement of FIG. 7 enclosed in an acoustic suspension speaker 55 according to an alternative embodiment of the present invention. An acoustic suspension loudspeaker driver 60 according to the present invention is retrofitted with the passive arrangement of FIG. 7. The passive arrangement of FIG. 7 is located and attached behind the loudspeaker driver 60 within the sealed enclosure 65 of the acoustic suspension speaker 55. As the diaphragm of the loud speaker driver 60 moves, the change in air pressure within the sealed enclosure 65 causes the diaphragm 21 of the passive arrangement to move, thus providing the air spring characteristics of a large volume of gas and creating a larger effective sealed volume (such as that of the traditional acoustic suspension loudspeaker of FIG. 9). The configuration of FIG. 8 wherein the rigid diaphragm structure 21 is replaced by a taut, flexible membrane 33 may also be used in the system depicted in FIG. 10.

The condensed speaker system described herein has many potential applications in the commercial and private use of speaker systems, especially those which benefit from light, mobile and efficient high fidelity speakers that also require a high quality of sound in the mid and lower frequencies. These include (among others): home theater systems, car audio systems and other vehicle systems, portable stereos and mobile professional acoustic systems for live music performances. Passive systems based upon the present invention such as those in FIG. 7 and FIG. 8 also have applications in systems that may benefit from pressure equalization or passive noise abatement such as in car interiors or HVAC duct work wherein sudden changes in air pressure may be neutralized.

While the invention herein disclosed has been described by means of specific embodiments and applications thereof, numerous modifications and variations could be made thereto by those skilled in the art without departing from the scope of the invention set forth in the claims.

The invention claimed is:

1. A speaker system comprising:

a speaker driver having a diaphragm;

a sealed low pressure chamber adjoining a portion of the diaphragm operable for creating unequal pressure on either side of the diaphragm to force the diaphragm in a first direction;

means for forcing the diaphragm in a second direction opposite of the first, wherein the means for forcing the diaphragm in a second direction opposite of the first direction comprises a sealed high pressure chamber adjoining a portion of the diaphragm, operable for forcing the diaphragm in a second direction opposite of the first direction, and a pressure in the high pressure chamber is sufficient to provide an equivalent force against the diaphragm in the second direction to a force provided by the low pressure chamber to the diaphragm in the first direction;

a portion of a housing of the speaker system forming a wall of the high pressure chamber; and a hollow voice coil former extending through the wall of the high pressure chamber, the high pressure chamber sealed at the exterior of the voice coil former between the wall of the high pressure chamber and the voice coil former with half-roll surrounds, the voice coil former having a first open end and a second enclosed end, the first end located within the high pressure chamber and the second end located at the diaphragm and attached to the diaphragm at the exterior of the voice coil former, operable for moving the diaphragm as the voice coil moves.

2. The speaker system of claim 1 wherein a surface area to which the force in the second direction is applied is a fraction of the surface area of the diaphragm.

3. The speaker system of claim 2 wherein the fraction of the surface area of the diaphragm is approximately 1/10.

4. The apparatus of claim 1 wherein the diaphragm is a rigid diaphragm structure.

5. The apparatus of claim 1 wherein the diaphragm is a taut, flexible membrane.

6. The apparatus of claim 1 further comprising a speaker having a sealed enclosure in which the apparatus is enclosed.

7. A speaker system comprising:

a speaker driver having a diaphragm;

a low pressure chamber adjoining a portion of the diaphragm operable for forcing the diaphragm in a first direction;

a high pressure chamber adjoining a portion of the diaphragm operable for forcing the diaphragm in a second direction opposite of the first direction;

a second speaker driver having a second diaphragm, the high pressure chamber adjoining a portion of the second diaphragm operable for forcing the second diaphragm in the first direction; and a second low pressure chamber adjoining a portion of the second diaphragm operable for forcing the diaphragm in the second direction.

* * * * *